United States Patent [19]

Reed

[11] 4,011,788

[45] Mar. 15, 1977

[54] STRIPPER/DE-LINKING MECHANISM

[75] Inventor: Frederick P. Reed, Davenport, Iowa

[73] Assignee: The United States of America as represented by the Secretary of the Army, Washington, D.C.

[22] Filed: Jan. 16, 1976

[21] Appl. No.: 649,627

[52] U.S. Cl. ..... 89/33 C

[51] Int. Cl.[2] ..... F41D 9/02

[58] Field of Search ..... 89/33 R, 33 BB, 33 BC, 89/33 C, 33 CA

[56] References Cited

UNITED STATES PATENTS 2,889,749 6/1959 Janson ..... 89/33 CA 3,563,132 2/1971 Cashen et al. ..... 89/33 BB

*Primary Examiner*—Stephen C. Bentley

*Attorney, Agent, or Firm*—Nathan Edelberg; Harold H. Card, Jr.; Robert O. Richardson

[57] ABSTRACT

Stripper/De-linker assembly for disintegrating links of ammunition belts which is located in the feed tray and which rearwardly strips and delinks in the feed tray, links, each of which totally circumscribes the corresponding cartridge or round and remains on the cartridge or round during firing thereof.

8 Claims, 4 Drawing Figures

STRIPPER/DE-LINKING MECHANISM

GOVERNMENT RIGHTS

The invention described herein may be manufactured and/or used by or for the Government for governmental purposes without the payment of any royalty thereon.

BACKGROUND OF THE INVENTION

Heretofore, difficulties have been encountered in the separation of links of disintergating ammunition belts of some automatic weapons, such as automatic grenade launchers, particularily those weapons in which the individual links totally circumscribe the round and were delinked in the receiver rearwardly by the recoiling bolt.

The conventional feed tray mechanism, especially the feed pawl, was required to cope with the varying dynamic force loads of the remaining rounds linked in the belt, due both to feeding and belt surge, while attempting to feed individually each linked round to the firing chamber for firing thereof. The varying load forces produced by the moving belt, as well as the surge force loads of the moving belt were translated to the weapon and resulted in unpredictable dilatorious effects on the weapon firing rate and on its hit probability. It will be appreciated, also, that the firing rate and hit probability of the weapon were also adversely affected by the lessening of the belt load on the weapon, during sustained firing, due to weight reduction of the belt ammunition supply, e.g. as the belt load forces were reduced, because of reduction in ammunition supply, the weapon firing rate increased, affecting thereby weapon control and, thus, target hit probability.

Moreover, where the delinking is to occur in the receiver after the round is fired, the gunner, in the event of failure of the stripping operation or in the event only partial stripping of the link in the firing chamber occurs, causing the weapon to jam, is required to open the feed cover and remove the unstripped or partially stripped round from the receiver, after having first delinked the chambered round from the remainder of the belt, thereby presenting substantial safety hazards.

Furthermore, because the link design configuration is generally fixed before the feed tray design is begun, a link which encompasses totally the casing and must be stripped rearwardly toward the breech, severely limits the design parameters of a link stripping assembly slaved to the configuration of the link.

In addition, the requirement that the link perform an indexing function to center the round for delivery from the feed tray to the firing chamber position in the receiver imposes further limitations on the design of a stripper assembly capable of stripping the links in the feed tray prior to delivery to the firing chamber.

In prior art link design, the "pitch" between links was also a limiting factor in weapon design. For purposes hereof, "pitch" is defined as the distance between the vertical centerlines of two adjacent rounds linked together with the link connection therebetween under full extension without stress thereon. The pitch distance was instrumental in determining the wall thickness of the barrel of the prior art weapons. The barrel wall thickness was dictated by the distance, and, therefore, had to be sufficiently thin to permit feed of only one round into the firing chamber from the feed tray, even though the rounds were linked when one was fed into the firing chamber.

SUMMARY OF THE INVENTION

The above and other problems, difficulties, and disadvantages of the prior art are substantially overcome by utilization of the stripper-delinker assemblies of the present invention for metallic ammunition belt links of the disintegrating type which links 40,42 and 44 circumscribe totally the casing of the round, even when the round is being fired, such as the links used with non-shoulder fired automatic grenade launchers.

The stripper-delinker assembly comprises a pair of spaced stripper members 4 and 6 which are located in the ammunition feed tray mechanism 2 and 180° disposed from each other, adjacent to the barrel firing chamber and which are positioned to strip rearwardly each link in the feed tray and simultaneously to disengage the link of the round about to be chambered for firing from the link of the adjacent round. The stripping-delinking functions occur just prior to positioning for chambering of the delinked round in the receiver. The stripper members do not remove the link from the round but displace the link, by the stripper action, rearwardly towards the base of the round, this displacement also being sufficient to cause disengagement of the stripped link from the link of the succeeding round in the feed tray. The stripping action is sufficient to relocate the stripped link still encompassing the round casing and position the link so that it does not interfere with firing of the round.

Actuation of the stripper members simultaneously is in response to movement of the recoiling parts of the weapon, such as indicated by the arrow in the drawing, by movement of the bolt of the weapon during recoil.

A positive, independent and automatic means 24 is also provided to return the stripper members to their inactive positions after each delinking operation in response to the position of the recoiling parts, such as the bolt of the weapon, during counterrecoil movement thereof.

BRIEF DESCRIPTION OF THE DRAWING

The foregoing and other features, objects and advantages of the present invention will become readily apparent to one skilled in the art from a reading of the following description of a preferred embodiment of the present invention, when read in conjunction with the accompanying drawing, wherein like reference numerals refer to like and corresponding parts throughout the several views, and wherein.

DESCRIPTION OF PREFERRED EMBODIMENT

Figure 1:
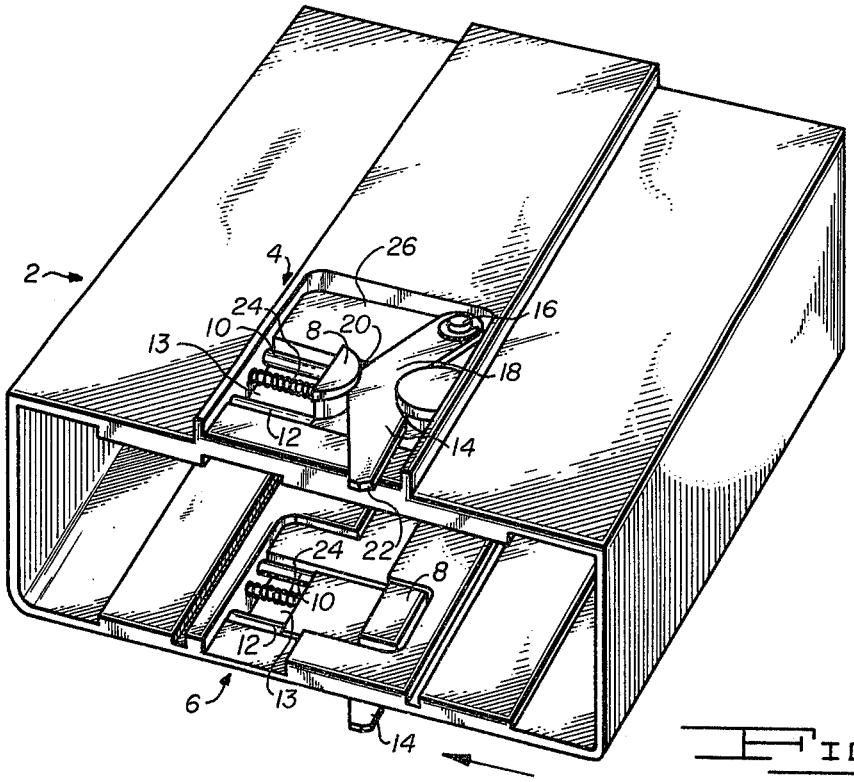
FIG. 1 is a perspective view of a feed tray for an automatic grenade launcher incorporating the stripper-delinker assembly of the present invention.

In FIG. 1 is illustrated a conventional feed tray 2 for an automatic non-shoulder fired launcher (not shown) for high velocity grenades which has been modified to incorporate the stripper-delinker assembly of the present invention. The stripper-delinker assembly of the invention includes an upper stripper-delinker mechanism or unit, generally indicated by the numeral 4, and a lower stripper-delinker mechanism 6, which units 4 and 6 co-act in unison to strip rearwardly and delink rounds in the feed tray 2, prior to positioning for chambering of each individual round in the firing chamber, not shown.

Figure 2:
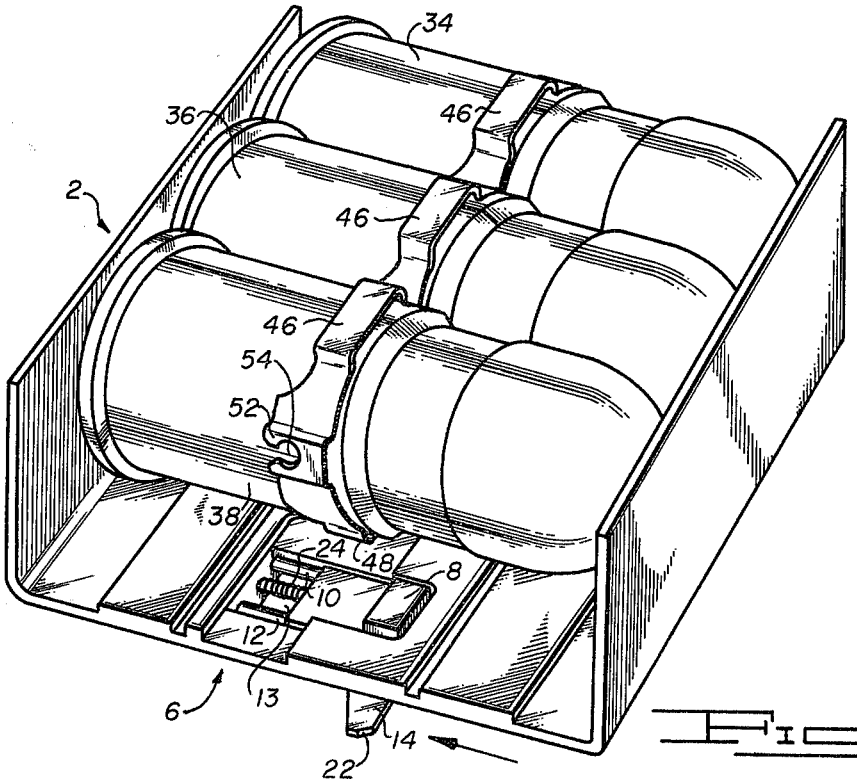
FIG. 2 is a perspective view of the feed tray of FIG. 1 with the upper stripper-delinker assembly removed illustrating linked rounds being fed into the stripper-delinker area.
Figure 3:
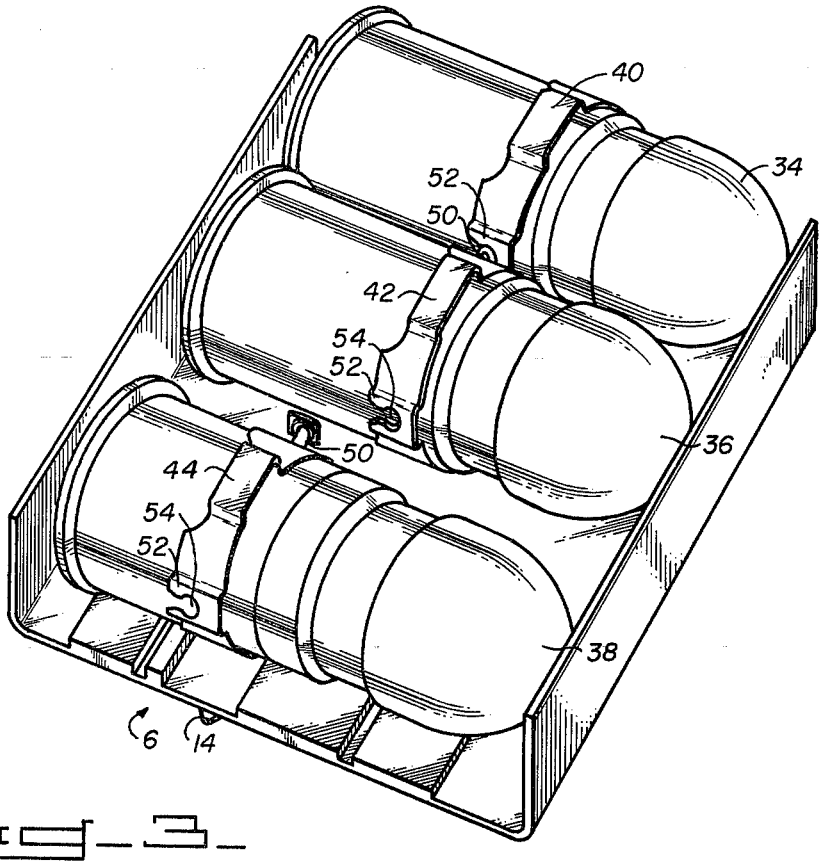
FIG. 3 is similar to FIG. 2 but illustrates the round being fed into the firing chamber after its link has been stripped rearwardly and thereby disconnected from the next round in the feed tray.

FIG. 1 illustrates the upper stripper delinker unit 4; FIGS. 2 and 3 illustrates the lower stripper delinker unit 6 which is a mirror image of unit 4, and FIG. 4 is a cross section illustrating the stripping-delinking coaction between these two units 4 and 6.

Each of these units 4 and 6 includes a horizontally disposed, reciprocable stipper body member 8 which slides on a pair of spaced guide rods 10 and 12 in an opening 13 formed in the feed tray 2. An arcuate elongate lever arm 14 is pivoted at one end 16 (FIG. 1) to the feed tray 2, has a body portion 18 nested in a recess 20 in the outer surface of the stripper body member 8 with its outer end 22 extending in the path of movement of the moving parts of the grenade launcher, such as the bolt indicated in FIGS. 1 and 2 by the arrow. It will be appreciated that, when the moving or reciprocating parts of the grenade launcher simultaneously pivot the lever arms 14 to the left, as view in FIG. 1, the pivoting lever arms 14 will cause linear movement of the stripper body members 8 also to the left (FIG. 1). The degree of pivoting movement of the lever arms 14 will be, of course, dictated by the length of travel, during recoil, of the moving parts of the grenade launcher selected to actuate movement of the lever arms 14 to perform the stripping-delinking function. To facilitate the stripping-delinking function, the body portions 18 (FIG. 1) of the lever arms 14 and the arm engaging surfaces of the recesses 20 of the stripper body members 8 are corresponding angularily contoured.

Figure 4:
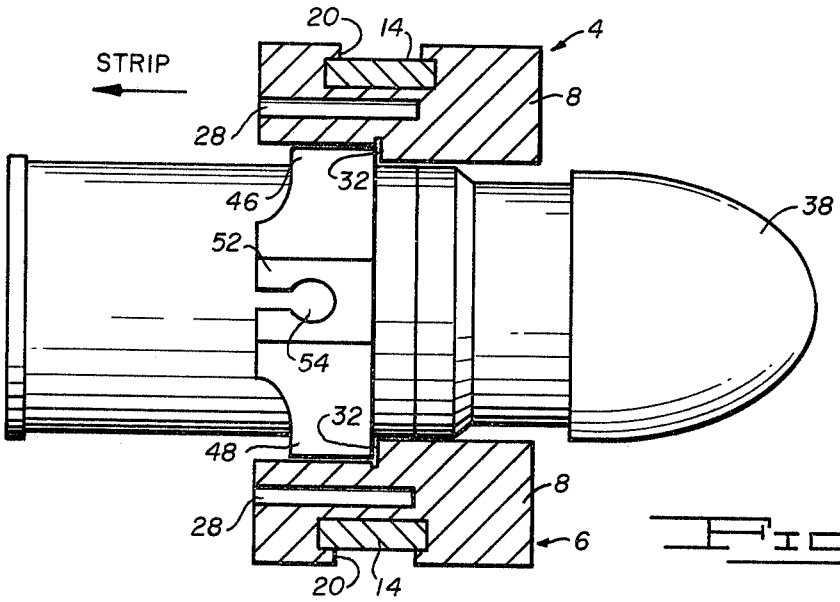
FIG. 4 illustrates in cross section the upper and lower stripper-delinker mechanism just prior to a stripping-delinking operation.

Return of the stripper-delinker units 4 and 6 to their inactivated positions shown in FIG. 1, is assured by a stripper delinker return spring means 24 circumscribing a guide rod 26 which is carried by the tray 2 between the two guide rods 10 and 12 and is slideably carried in a bore 28 formed in the stripper delinker body member 8 (FIG. 4). The return spring 24 is bottomed at one end against the feed tray 2 and at its other end against the moveable body member 8.

Each of the body members 8, as best seen in FIG. 4, includes a stepped portion defining a stripping and delinking shoulder 32 for causing rearward stripping of links, each of which totally circumscribe the round and which, in the embodiment disclosed in the drawing, remain on the round during firing thereof.

In FIG. 3, there are shown three rounds 34, 36, and 38 each having a link 40, 42 and 44 totally circumscribing the corresponding round. Each link 40–44 has a pair of spaced stripper engageable raised surfaces, 46 and 48 each on diametrically opposed sides of the link (FIG. 4). Each link also carries approximately 90° from the raised surfaces 46 and 48, a male toggle member 50 90° opposite a raised female toggle member 52 having a rearwardly open male toggle receiving opening or slot 54.

Positioning of the male toggle member 50 of one round link into the slot 54 of the adjacent link results in linking the rounds in belt form. It is to be understood that the foregoing description of a link configuration and linking toggle arrangement represents but one form of link design and disintegrating link attachments to form belts useful in the practice of the present invention. The link configuration need only have surfaces engagable by the stripper to strip the link rearwardly, with the connection between links being disintegrating during the stripping action.

In operation, the upper and lower stripper units 4 and 6 and levers 14 are biased to the right, as viewed in FIG. 1, under the influence of springs 24 to the inactived position. Means (not shown) indexes a linked round onto the lower stripper unit 6 in the feed tray 2 and simultaneously a delinked round (not shown) into the firing chamber (not shown). The delinked round is fired and the moving parts, such as the bolt, indicated by the arrow in FIG. 1, recoil. The recoiling parts engage the upper and lower stripper delinker lever arms 14 which, in pivoting in unison, cause linear movement of the stripper-delinker bodies 8 aganst the bias of the springs 24 thereby compressing the springs 24. Continued rearward movement of the stripper-delinker body members 8 towards the breech of the launcher causes engagement of the pair of upper and lower opposed stripper-delinker body shoulders 32 (FIG. 4) with the corresponding opposed raised surfaces 46 and 48 of the link 40 of the round 38 resting between the stripper-delinker units 4 and 6. Further rearward movement of the recoiling parts and lever arms 14 continues movement of the stripping shoulder 32 against the link 44 which begins to move the link 44 rearwardly to unseat the male toggle member 50 (FIG. 3) from the slot 54 in the adjacent link 42 thereby delinking adjacent links 44 and 42. Stripping of the link 44 on the round 34 a predetermined distance is determined by completion of the recoil movement or displacement of the recoiling parts of the launcher.

The now delinked and stripped but still link-carrying round 38 is now ready to be moved in any convenient manner from between the upper and lower units 4 and 6 into position for chambering in the firing chamber and the next linked round 36 is then fed between the upper and lower stripper-delinker body members 8.

When the recoiling parts of the launcher begin their return counterrecoil movement, the compressed springs 24 acting on the body members 8 of the upper and lower units 4 and 6 return the body members 8 and lever arms 14 to their inactivated positions (FIG. 1) ready to receive the next linked round 36 for repetition of an identical stripping and delinking cycle.

It is to be understood that, although a preferred embodiment of the present invention has been shown and described herein, the present invention is not limited thereto, because variations and other embodiments will become readily apparent to those skilled in the art from the foregoing description. Accordingly, the present invention should be considered limited only by the scope of the following claims.

I claim:

1. In an automatic or semiautomatic weapon system having a receiver including a firing chamber, an ammunition belt feed tray mechanism for feeding rounds individually to said firing chamber, an ammunition belt of the disintegrating type in said tray mechanism, with individual round link members, each of said members totally circumscribing its corresponding round, and weapon system recoiling parts, the improvement comprising:

link stripper and delinker means carried by said feed tray mechanism adjacent said firing chamber for movement from a first position to a second position to strip and delink each link from the next succeeding link in the linked belt prior to introduction of the delinked round into the receiver, said stripper delinker means comprising a pair of spaced units, each unit comprising a movable body member having a link engaging stripper and delinking shoulder, and guide means carried by the feed tray mechanism for guiding movement of said stripper delinker body member between said positions.

means carried by the recoiling parts to actuate movement of the stripper delinker means from said first position to said second position to effect said stripping and delinking function, and means for automatically moving said stripper delinker means from said second position to said first position upon completion of the stripping and delinking function.

2. The system of claim 1 wherein each of the stripper delinker body members extends through an opening formed in the feed tray mechanism and said guide means includes a pair of guide rods slideably carrying the body members in a position with the link engaging shoulders facing each other in spaced relation a distance sufficient to permit engagement of said shoulders with opposed sides of each of said links to strip said links.

3. The system of claim 2 wherein each of said body members is recessed on its side opposite said stripping shoulder and each of said stripper delinker units includes an arcuate lever arm extending through said recess and pivotably carried adjacent one end by the feed tray mechanism with its other end extending in the path of recoil movement of said recoiling parts for engagement with said lever arms to thereby move said stripper delinker means from said first position to said second position.

4. The system of claim 3 wherein said automatic means includes a spring and spring guide rod assembly, said spring guide rod being carried in the opening of the feed tray mechanism, said spring guide rod also being connected at one end to said feed tray mechanism and being disposed at its other end in a bore in the unit body member to permit slideably movement of the body member, said spring circumscribing said guide rod and being bottomed at one end against said feed tray mechanism and at its other end against the body member to bias the body member to said first position.

5. In an ammunition feed tray mechanism for feeding rounds having totally circumscribing individual links connected to form ammunition belts of the disintegrating link type through a lateral feed inlet into the firing chamber of receivers of automatic or semiautomatic weapon systems, the improvement comprising:

means carried by the feed tray mechanism for movement from a first position to a second position for partially stripping and disconnecting each of the links individually and breechward prior to introduction of the stripped round into the receiver feed inlet, and means carried by the receiver for moving said movable means from said first position to said second position to cause said stripping of said links.

6. The feed tray mechanism of claim 5 including means for moving said movable means from said second position to said first position.

7. The feed tray mechanism of claim 2 wherein said receiver carried means is the recoiling parts of the weapon system.

8. The feed tray mechanism of claim 5 wherein each link in each pair of connected links is disengaged from the next adjacent link by contact of said movable means during movement thereof from said first position to said second position.

* * * * *